United States Patent [19]

Steers et al.

[11] Patent Number: 4,528,558

[45] Date of Patent: Jul. 9, 1985

[54] DOOR-OPEN ALARM DEVICE FOR A REFRIGERATING APPLIANCE

[75] Inventors: Michel Steers, Chennevieres-sur-Marne; Jean-Pierre Hazan; Michel Courdille, both of Sucy-en-Brie, all of France

[73] Assignee: U.S. Philips Corporation, New York, N.Y.

[21] Appl. No.: 393,897

[22] Filed: Jun. 30, 1982

[30] Foreign Application Priority Data

Jul. 9, 1981 [FR] France ..... 81 13546

[51] Int. Cl.[3] ..... G08B 21/00

[52] U.S. Cl. ..... 340/686; 340/545; 340/585; 340/549; 49/13

[58] Field of Search ..... 49/13, 14; 340/545, 340/549, 52 D, 56, 686, 585; 200/61.79, 61.82, 61.93, 318; 116/86, 100, 101; 180/271, 286, 274; 62/129, 125; 160/10; 232/36, 37

[56] References Cited

U.S. PATENT DOCUMENTS

| | | | |
|---|---|---|---|
| 3,210,748 | 10/1965 | Onuffer | 116/101 X |
| 3,803,576 | 4/1974 | Dobrzanski et al. | 340/545 X |
| 3,955,183 | 5/1976 | McBrian | 340/545 X |
| 3,975,723 | 8/1976 | Bowling et al. | 340/686 |
| 4,006,451 | 2/1977 | Nobile | 340/545 X |
| 4,249,161 | 2/1981 | Mohnhaupt | 340/52 D |
| 4,278,968 | 7/1981 | Arnett et al. | 340/545 |
| 4,438,428 | 3/1984 | Ober et al. | 340/549 X |

FOREIGN PATENT DOCUMENTS

| | | | |
|---|---|---|---|
| 1258395 | 12/1971 | United Kingdom | 340/52 D |

OTHER PUBLICATIONS

"Fridge Alarm", *Elektor,* vol. 6, pp. 11-34, 11-35, Nov. 1980.

*Primary Examiner*—James L. Rowland
*Assistant Examiner*—Thomas J. Mullen, Jr.
*Attorney, Agent, or Firm*—Robert T. Mayer; Bernard Franzblau

[57] ABSTRACT

A door-open alarm device comprises alarm means connected to an electric circuit which comprises, arranged on the stationary part (11), a voltage source, a switch (13) having two positions in which the circuit is interrupted and closed respectively, electrical time delay means responsive to a current flow in the circuit to produce a voltage variation across said alarm means after a time delay, thereby triggering said alarm means. Arranged on the door (12) is a mechanical actuating element (14) for said switch, which opens said switch when the door is wide open or closed, and which closes said switch when the door is ajar.

16 Claims, 5 Drawing Figures

DOOR-OPEN ALARM DEVICE FOR A REFRIGERATING APPLIANCE

The present invention relates to a door-open alarm device, specifically for a refrigerating appliance, and to a freezer and/or refrigerator equipped with such a device.

Although the device may be used in conjunction with any door system with a stationary frame, the invention will be described hereinafter specifically for a door of a refrigerating appliance—refrigerator or freezer—which for simplicity is referred to hereinafter as a refrigerator.

It may happen that when the door of a refrigerator is closed it is not correctly locked so that it opens and remains ajar. If there is no alarm which is responsive to this partly open condition the products and substances stored in the refrigerator may rise in temperature, as a result of which they may be spoilt.

In the prior art it has been considered to equip these refrigerators with alarm systems responsive to the non-closed condition of these refrigerators. For the sake of convenience the system should allow the door to be opened for loading, unloading, or cleaning of the refrigerator without the alarm being activated without cause. U.S. Pat. No. 3,996,434, which most closely resembles the present invention, therefore proposes a "delayed" de-activation of the alarm for a predetermined time before it responds, or a "non-delayed" de-activation of said alarm during the full time necessary for the said operations. This "non-delayed" de-activation has the disadvantage that it requires direct manual resetting of the alarm device itself, which may be omitted. Another problem is that through human error this non-delayed de-activation of the alarm may persist after the refrigerator has been closed again if there is no automatic reactivation of the alarm in response to the closure of the door or, if this is present, when the door is not closed completely so that it is not locked. Said Patent proposes such an automatic reactivation in response to the closure of the door but the actuating element of the device which is responsive to the position of the door is mechanical and if inadvertently the door is not completely closed by the user it may happen that the device is not effectively reactivated. Moreover, the proposed alarm device is comparatively intricate as regards its mechanical construction, so its manufacture may be rather expensive.

It is an object of the invention to propose a very simple device which, in view of its use in mass-manufactured appliances, can be manufactured in a cheaper manner. Another object of the invention is to ensure that the operation of the proposed device is independent of human error. For this purpose it operates without any direct human intervention other than moving the door, the alarm being automatically de-activated by the door itself when its position corresponds to the closed position or to a position in which it is so far open that access can be gained to the interior of the refrigerator and, conversely, it is activated when the position of the door is such that it corresponds to an opening which is too small to give access to the interior of the refrigerator. Typically, in the last-mentioned case the door makes an acute angle of approximately 20° relative to its closed position.

To this end the alarm device in accordance with the invention is characterized in that it comprises, arranged on the stationary part of the appliance, alarm means connected to an electric circuit which comprises a voltage source, a switch having two positions which correspond to the circuit being interrupted and closed respectively, electrical means providing a time delay when a current flows in the circuit and after a time delay producing a voltage variation across said alarm means, thereby triggering said alarm means. Arranged on the door is a mechanical actuating element of said switch, having a geometrical shape such that the switch is in the open position when the door is wide open or closed, and is in the closed position when the door is ajar. In particular the electrical delay means are thermal means, with a thermal delay as a function of time which is sufficient to prevent the alarm from being triggered during the time necessary for directly setting the door from the closed position to the wide open position for normal use of the refrigerator.

In one embodiment said thermal means comprise a resistor with a negative temperature coefficient (NTC) connected in series with the voltage source and the switch to a pair of terminals of the alarm means.

In another embodiment said thermal means comprise a resistor with a positive temperature coefficient (PTC) arranged in parallel with the series arrangement of the voltage source and the switch. A first terminal of the alarm means is connected to one terminal of the PTC resistor and a second terminal of said alarm means to the other terminal of the PTC resistor via a resistor whose resistance value is smaller than the resistance value of the PTC resistor when the PTC resistor carries a current.

In a further embodiment the thermal means comprise a bimetal element surrounded by a heating coil, through which the current of the circuit flows. The bimetal element changes over and makes contact with another circuit branch to produce the voltage variation across the alarm means necessary to trigger said means.

In other embodiments the electrical time delay means comprise RC integrating circuits or a clock generator and a counter.

Embodiments of the invention will now be described in more detail, by way of example, with reference to the drawings, in which.

Figure 1:
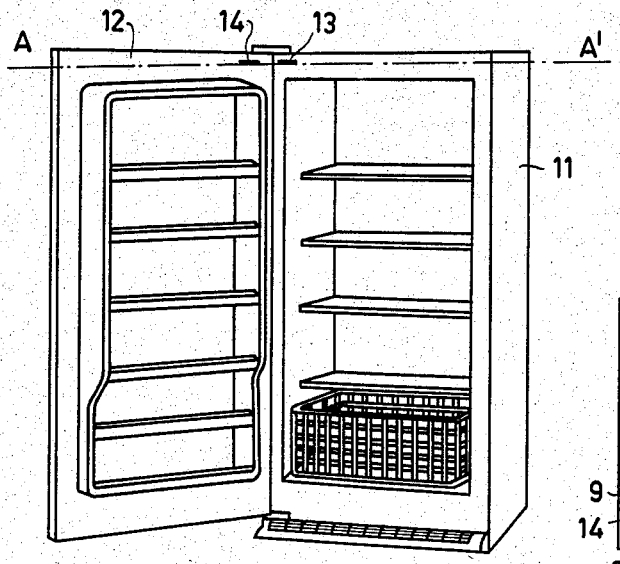
FIG. 1 shows a refrigerating appliance equipped with the alarm system in accordance with the invention.
Figure 2:
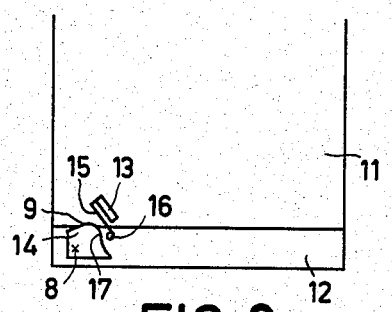
FIG. 2 is a bottom view of the actuating element of the alarm system.

FIG. 1 shows a refrigerating appliance with an open door. The storage compartment and the door are designated 11 and 12 respectively. The elements 13 and 14, which are respectively located on the storage compartment and on the door, schematically represent the two parts of the actuating element of the alarm system in accordance with the invention. Element 13 is a two-position switch in the electric circuit and element 14 is a cam which co-operates with said switch. In FIG. 2 this actuating element is shown in bottom view in accordance with the line AA'. This Figure shows the storage compartment 11 and the door 12 which is movable about the axis 8. The switch 13 comprises a lever 15 having an end 16 which co-operates with the profile 9 of cam 14. When the door 12 is closed the lever 15 is not in contact with the cam 14 and is in a position which corresponds to an interrupted condition of the electric circuit in which the switch is included. Conversely, when the door is half open the cam presses against the end 16 of the lever 15 with the projection 17 of its profile. The lever 15 then is urged into a position in which the circuit is closed. When the door is wide open the cam is no longer in contact with the lever 15 so that the electric circuit is again interrupted.

In accordance with the invention the cam and the switch may be of different constructions, but in any case only the position of the door in which it is ajar should cause the electric circuit to be closed via the switch 13.

Figure 3:
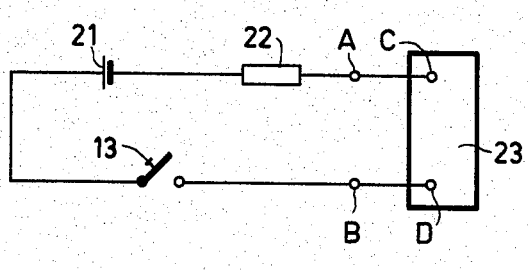
FIG. 3 shows the circuit diagram of the alarm system in a first embodiment of the invention.

FIG. 3 is the circuit diagram of the alarm device associated with the actuating element described in the foregoing, in a first embodiment. This electric circuit comprises the series arrangement of the voltage source 21, the switch 13 shown in FIGS. 1 and 2, and an electrical time delay element a resistor with a negative temperature coefficient (NTC) 22. The terminals A and B of this circuit are connected to the respective terminals C and D of the alarm means represented by the block 23. When the switch has been in the closed position while the door is ajar for a sufficiently long time, the current through the NTC resistor 22 reduces the resistance of said resistor as a result of heating and produces a voltage rise across the terminals A and B, which rise causes the alarm means 23 to be triggered. When the door is wide open the circuit does not remain closed for a sufficiently long time during the movement of the door to allow the current to heat the NTC resistor sufficiently to trigger the alarm device, taking into account its resistance value and its thermal delay. Suitably, the NTC resistor is arranged in the refrigerating section of the appliance so that it is not subject to variations in ambient temperature.

Figure 4:
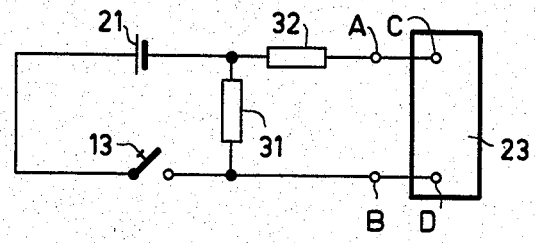
FIG. 4 shows the circuit diagram of the alarm system in a second embodiment of the invention.

In FIG. 4, which is the circuit diagram of another embodiment of the alarm device, the circuit comprises a resistor with a positive temperature coefficient (PTC) 31 in parallel with the voltage source 21 and the switch 13 and a resistor 32 in series with the alarm means 23, the value of the resistor 32 being lower than that of 31 when the current in the last-mentioned resistor corresponds to the position of the switch 13 in which it is closed for a sufficiently long time (door ajar). Then a voltage which is high enough to trigger the alarm means 23 will be produced across the points A and B.

Figure 5:
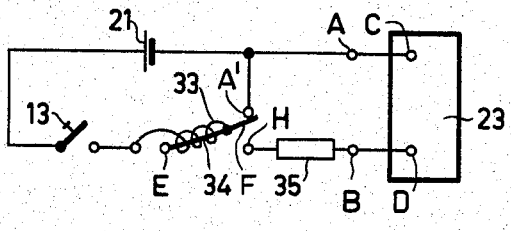
FIG. 5 shows the circuit diagram of the alarm system in a third embodiment of the invention.

In FIG. 5 the circuit diagram comprises a coil 33 in series with the voltage source 21 and the switch 13. Inside said coil a bimetal 34 is arranged. The bimetal is movable with the coil 33 about the point E. At the instant that the switch 13 is closed the end F of the coil contacts point A'. As a result of the bimetal being heated the bimetal switches over from point A' to point H, which is a terminal of a resistor 35 which is also connected to point B. As a result a volage is produced across points A and B and the alarm means 23 are triggered.

In another embodiment, the electrical time delay is obtained by means of an integrating circuit with a resistor and a capacitor, or by means of a clock generator and a counter.

It is evident that only a few embodiments of the invention have been described, specifically as regards the electrical circuitry, and that other variants which also fall within the scope of the invention will be obvious to those skilled in the art.

It is also evident that the alarm system described in the foregoing is particularly suitable for use in conjunction with a door of a refrigerating appliance (refrigerator, freezer), but that it may also be used in conjunction with any other door-closure control and monitoring system, for example a door lift.

We claim:

1. A door-open alarm device for a household appliance provided with a door and a stationary part on which the door is movably mounted, said device comprising: arranged on the stationary part of the appliance, alarm means connected to an electric circuit comprising a voltage source, a switch having first and second positions which correspond to the electric circuit being interrupted and closed respectively, electrical means providing a time delay in response to a current flow in the electric circuit and after a time delay producing a voltage variation across said alarm means, thereby triggering said alarm means and, arranged on the door, a mechanical actuating element for operating said switch, said actuating element opening said switch when the door is wide open or closed, and closing said switch when the door is ajar.

2. An alarm device as claimed in claim 1, characterized in that the mechanical actuating element comprises a cam and the switch comprises a lever which co-operates with the cam.

3. An alarm device as claimed in claim 2, characterized in that the electrical time delay means comprise thermal means.

4. An alarm device as claimed in any one of claims 1 to 3, characterized in that the time delay means comprise a resistor with a negative temperature coefficient (NTC) connected in series with the voltage source and the switch to terminals of the alarm means.

5. An alarm device as claimed in claim 3 wherein the thermal means comprise a resistor with a positive temperature coefficient (PTC) connected in parallel with the series arrangement of the voltage source and the switch, and means connecting a first terminal of the alarm means to one terminal of the PTC resistor and a second terminal of said alarm means to the other terminal of the PTC resistor via a resistor having a resistance value smaller than the resistance value of the PTC resistor when the PTC resistor carries a current.

6. An alarm device as claimed in claim 3 wherein the thermal means comprise a bimetal element surrounded by a heating coil included in one of the branches of the circuit, said bimetal element changing over to make contact with another branch of the circuit to produce said voltage variation across the alarm means.

7. A device as claimed in claim 2, characterized in that the electrical time delay means comprise an RC integrating circuit.

8. A device as claimed in claim 2, characterized in that the electrical time delay means comprise a clock generator followed by a counter.

9. An appliance, specifically a refrigerating appliance, equipped with an alarm device as claimed in claim 1.

10. An alarm device as claimed in claim 1 wherein the electrical time delay means comprise a PTC resistor connected in parallel with the series arrangement of the voltage source and the switch, and means connecting a first terminal of the alarm means to one terminal of the PTC resistor and a second terminal of said alarm means to the other terminal of the PTC resistor via a resistor having a resistance value smaller than the resistance value of the PTC resistor when the PTC resistor is heated by a current flow therein.

11. In a household appliance including a stationary part and a door movably mounted thereon, the improvement comprising a door-open alarm device comprising: an alarm device having a pair of input terminals, an electric circuit coupled to said pair of input terminals for activating the alarm device when the door is in a predetermined range of positions corresponding to a partly open condition of the door and for deactivating the alarm device when the door is in a closed position or a wide open position, said electric circuit comprising: a source of voltage, a switch having a first position corresponding to the door being in said predetermined range of positions and a second position corresponding to the door being in the closed or wide open position, said switch positions corresponding to the electric circuit being interrupted or closed, and electric time delay means responsive to a flow of current in the electric current from said voltage source when the switch is operated into said first position thereby to produce a delayed voltage variation at the input terminals of the alarm device which activates the alarm device, and a mechanical actuating element for the switch arranged on the door so as to operate said switch into the first position when the door is in said predetermined range of positions and to operate the switch into the second position when the door is in the closed or wide open position.

12. An appliance as claimed in claim 11, wherein the mechanical actuating element comprises a cam and the switch is mounted on the stationary part and includes a lever which mechanically cooperates with the cam to operate the switch between said first and second positions.

13. An appliance as claimed in claim 11 wherein the time delay means comprise an NTC resistor connected in series circuit with the voltage source and the switch across the input terminals of the alarm device, said first and second switch positions being the closed and open positions of the switch, respectively.

14. An appliance as claimed in claim 11 wherein the time delay means comprise a PTC resistor connected in parallel with a series circuit including the voltage source and the switch, a resistor connecting one terminal of the PTC resistor to one of said alarm device input terminals, and means connecting the other terminal of the PTC resistor to the other input terminal of the alarm device, the resistance of the resistor being less than the resistance of the PTC resistor when the PTC resistor is heated by a current from the voltage source.

15. An appliance as claimed in claim 11 wherein said predetermined range of positions occur when the door makes an angle of approximately 20° relative to its closed position.

16. An appliance as claimed in claim 11 wherein the appliance comprises a refrigerating appliance.

* * * * *